US005244103A

United States Patent [19]

Padgett, II

[11] Patent Number: 5,244,103

[45] Date of Patent: Sep. 14, 1993

[54] HEALTH CLUB SALES DISPLAY

[76] Inventor: Bobby G. Padgett, II, 3821 Beach Dr. #202, Seattle, Wash. 98116

[21] Appl. No.: 877,654

[22] Filed: May 1, 1992

[51] Int. Cl.[5] ..... B42F 7/00

[52] U.S. Cl. ..... 211/50; 40/606

[58] Field of Search ..... 211/50, 45, 13; 40/1, 40/661, 538, 606; 248/441.1; D20/10, 40, 41, 42, 43

[56] References Cited

U.S. PATENT DOCUMENTS

| | | | |
|---|---|---|---|
| 2,979,841 | 4/1961 | Bellis . | |
| 3,570,728 | 3/1969 | DeWitt . | |
| 3,836,007 | 9/1974 | Rosenwein | 211/13 |
| 4,660,310 | 4/1987 | Farmer | 40/606 X |
| 4,726,132 | 2/1988 | Ernest | 40/606 X |
| 4,844,264 | 7/1988 | Deskiewicz, Jr. | 211/50 |
| 4,885,858 | 12/1989 | Strom . | |
| 4,941,276 | 7/1990 | Kanner | 40/538 |

*Primary Examiner*—Ramon O. Ramirez

*Attorney, Agent, or Firm*—Craine & Jackson

[57] ABSTRACT

A health club sales display having a free weight model attached to a vertically disposed support member capable of selectively holding a sign thereto. In the first embodiment, the free weight model is a dumb-bell replica designed to be placed horizontally on a flat horizontal surface, such as a counter top. The dumb-bell replica includes a left and right hollow weight stacks separated by a bar element. The support member is removably attached to the rear surface of the dumb-bell replica and extends upward vertically therefrom. In the preferred embodiment, the support member is made of rigid, transparent material. A vertically aligned sleeve is manufactured on the support member which enables a sign to slide therein and into a visible location. A slot is manufactured on one or both of the weight stacks which enables cards or tickets to be dropped inside the weight stack. An optional card holder may be manufactured on the support member designed to conveniently hold cards or tickets.

20 Claims, 6 Drawing Sheets

HEALTH CLUB SALES DISPLAY

BACKGROUND OF THE INVENTION

1. Field of the Invention

This invention relates to sales displays and more particularly, to sales displays used in the health club industry.

2. Description of the Related Art

Sales displays are commonly used today in many industries to sell goods and services. There are two general types of sales displays: the point of purchase sales display and the lead box sales display. The point of purchase sales displays are designed to attract consumers and entice them to purchase the goods or services being offered. The lead box sales displays are designed to attract consumers and entice consumers to submit their names, addresses, and phone numbers into a box attached to the display. Normally, the customer provides this information on a ticket or coupon in response to a contest being offered by the display owner. Later, the display owner collects the information on the ticket or coupon to produce leads of potential customers for display owner's goods or services.

It is common practice to set up a sales displays in other businesses or locations away from the display owner's place of business. For example in the health club industry, it is common practice to set up lead box sale displays in restaurants and stores located in the vicinity of the health club. Usually, the owner of the restaurant or store requires that the sale display be compact, attractive, and durable. Although the owner of the restaurant or store is usually compensated for the right to place the sales display in the restaurant or store, the display owner usually remains responsible for the sales display.

The effectiveness or success of the sales displays depends on several factors such as: the attractiveness of the display, the good or service being sold, and the location of the sale display. With lead box sale displays, the type of prize being offered, the contest rules, and the identity of the company which offers the contest, all play important roles in its effectiveness or success. Also, sale displays which incorporate in their design some aspect of the good or service being offered, are generally more effective.

SUMMARY OF THE INVENTION

According, it is an object of the present invention to provide a sales display designed specifically for a health club or a related business.

It is an object of the present invention to provide a health club sales display which can also function as a lead box sales display.

It is another object of the present invention to provide such a sales display which incorporates in its design a free weight model, such as a dumb-bell or bar-bell replica.

It is a further object of the present invention to provide such a sales display that is compact, attractive, and durable.

These and other objects of the invention are met by providing a health club sales display comprising a free weight model attached to a vertically disposed planar support member. In a first embodiment, the free weight model is a horizontally disposed dumb-bell replica. The dumb-bell replica has left and right hollow weight stacks separated by a bar element. The bottom surface of each weight stack is flat thereby enabling the dumb-bell replica to be positioned horizontally on a counter top.

The planar support member is fixed or slidingly attached to the rear sections of the two weight stacks using an attachment means. When attached, the support member is disposed between the two weight stacks with its longitudinal axis substantially perpendicular to the dumb-bell replica's longitudinal axis.

A holding means is provided for selectively holding a sign on the support member. In one embodiment, the support member is made of clear acrylic plastic material with the holding means comprising an extended sleeve manufactured horizontally across the support member. The sleeve is of sufficient size so that a sign may be placed edgewise therein thereby enabling any advertisement or information printed on the sign to be visible to customers positioned in front of the sales display.

In a second embodiment disclosed herein, the free weight model comprises a bar-bell replica and a vertically disposed support member. The bar-bell replica is designed to be a free standing display device. The bar-bell replica comprises an upper and lower hollow weight stack separated by a bar element. During use, the lower weight stack is placed on the ground on its outer surface with the longitudinal axis of the bar element disposed vertically. The upper weight stack is held directly above the lower weight stack. A lead weight may be placed inside the lower weight stack to provide stability.

The support member, the attachment means, and the holding means used in the second embodiment are identical to the support member, the attachment means, and the holding means used in the first embodiment. The support member is fixed or slidingly attached to the rear portion of the upper weight stack with its longitudinal axis parallel with the bar-bell replica's longitudinal axis.

With each embodiment, the sales display can be used as a point-of-purchase sales display or a lead box sales display. When designed as a lead box sales display, a slot is manufactured on one or both free weight stacks which enables customers to drop cards or tickets into the space located inside each weight stack. The support member is removably attached to the free weight model so that the cards or tickets may be removed. An optional card holder box may also be attached to the front surface of the support member which conveniently holds a stack of cards or other similar items.

DESCRIPTION OF THE PREFERRED EMBODIMENT(S)

Figure 1:
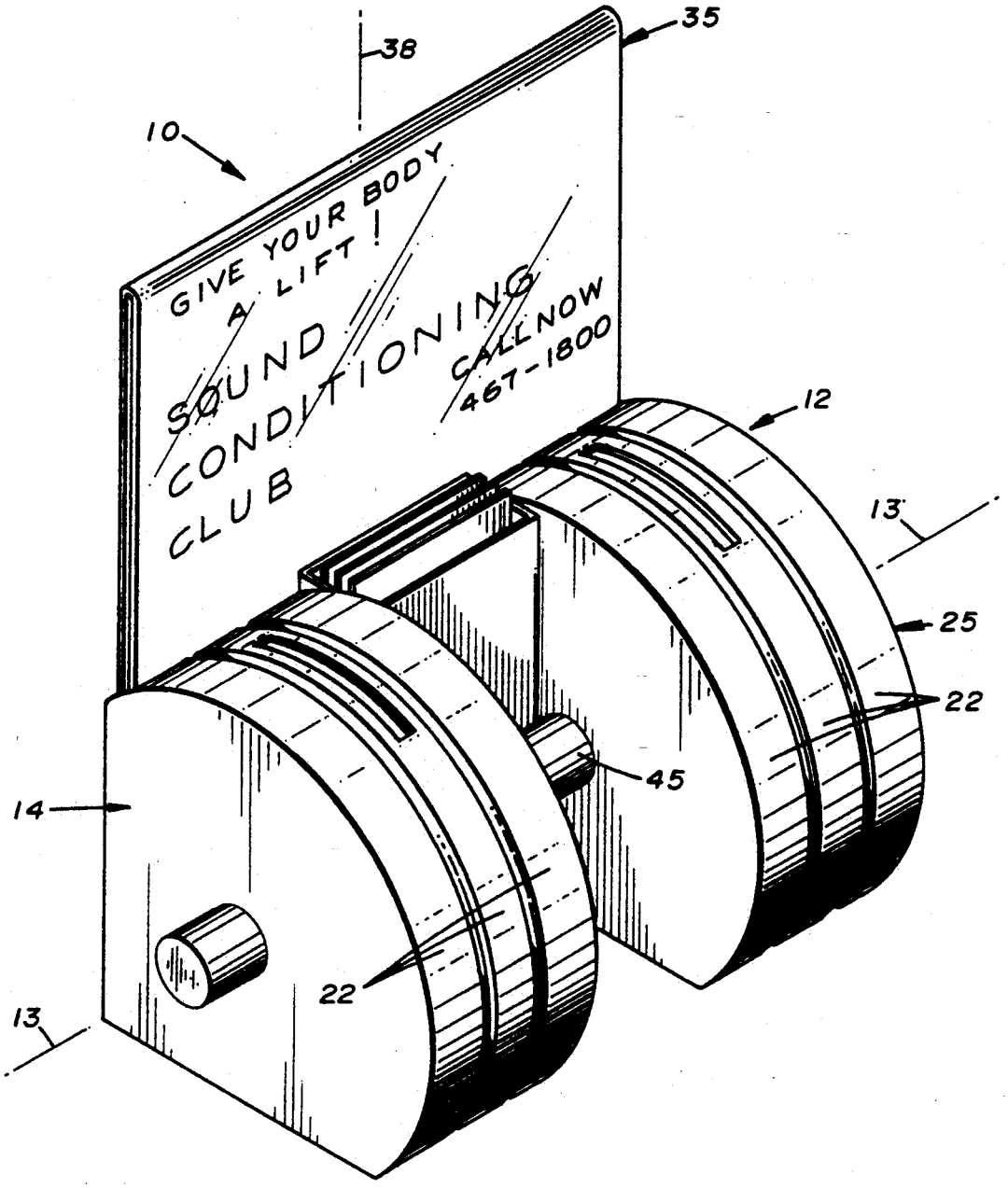
FIG. 1 is a perspective view of one embodiment of the health club sales display described herein.

Shown in the accompanying FIGS. 1-12, there is shown a health club sales display device 10 as a point of sale display or a lead box sales display for a health club or related business.

In the first embodiment, shown in FIGS. 1-8, the sales display 10 comprises a small, compact free weight model, made of lightweight, durable material, designed to be placed horizontally on a surface, such as a window sill or counter top. The free weight model is a replica of a real dumb-bell, hereinafter known as a dumb-bell replica 12. The dumb-bell replica 12 is designed to include key identifiable elements found on dumb-bells commonly used today in health clubs and fitness centers.

As shown in FIGS. 1-4, the dumb-bell replica 12 includes a left and right weight stacks 14 and 25, respectively, separated by a bar element 45. Each weight stack 14, 25 is a hollow structure with a curved front surface 15, 26, respectively, a flat inner surface 17, 28, respectively, a flat outer surface 18, 29, respectively, and a flat bottom surface 19, 30, respectively. The rear portion of each inner and outer surfaces 17, 28; and 18, 29, respectively, is manufactured straight approximately perpendicular to the flat bottom surface 19, 30, respectively. The rear portion of each weight stack 14 and 25 is uncovered thereby providing rear openings (rear opening 21 shown only in FIG. 5) into each weight stack. Two grooves 16, 27 are also manufactured across the curved front surface 15, 26 of each weight stack 14, 25, respectively, from the front to the back to simulate a plurality of weight plates 22 stacked side by side. The bottom surface 19, 30 of each weight stack 14, 25, respectively, is flat thereby enabling the dumb-bell replica 12 to rest with its longitudinal axis 13 parallel with a horizontal flat surface, such as a counter top.

In the preferred embodiment, the dumb-bell replica 12 measures approximately 14 inches in length with each weight stack 14, 25 measuring approximately 6 inches in height. The surfaces of the dumb-bell replica 12 are made of ⅛ to ¼ acrylic plastic material joined together along their edges by a suitable adhesive. The dumb-bell replica 12 may be manufactured with other materials, such as cardboard or wood.

Figure 5:
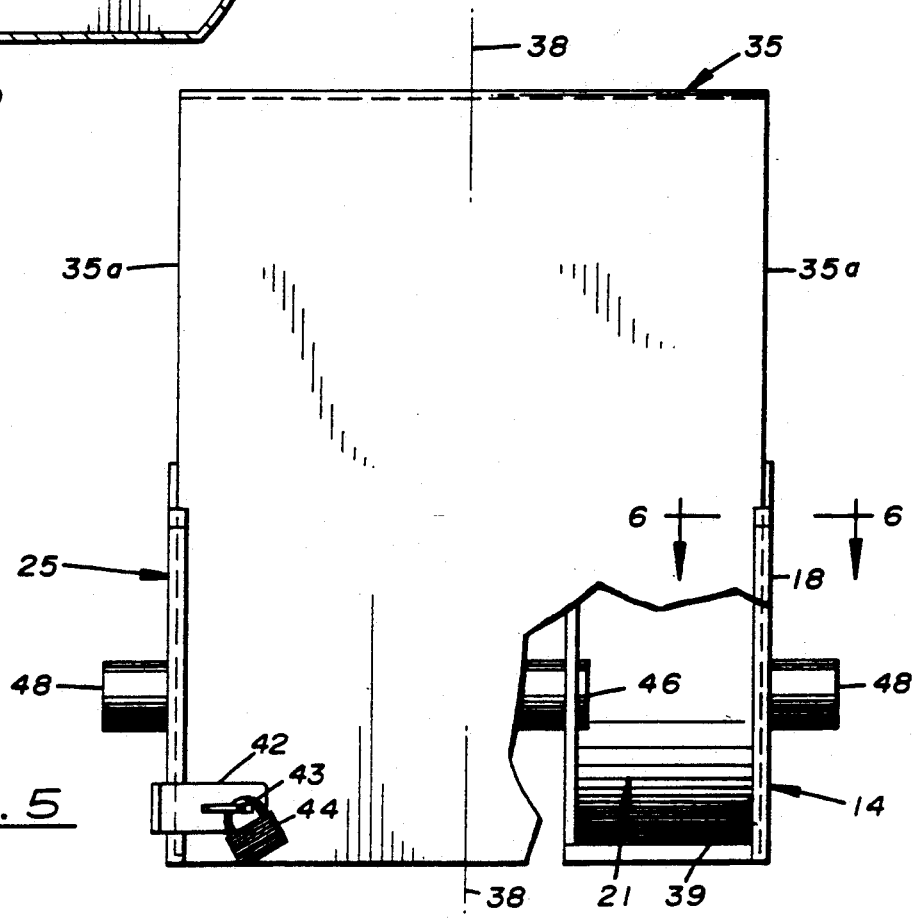
FIG. 5 is a rear elevation view, partly in section of the health club sales display shown in FIGS. 1–4.

As shown in the FIG. 5, the rear section of each weight stack (stack 14 shown) is open thereby enabling each weight stack 14, 25 to serve as a collection box for cards 40 or other items inserted through slots 23 and 33 manufactured on front surfaces 15 and 26.

Figure 2:
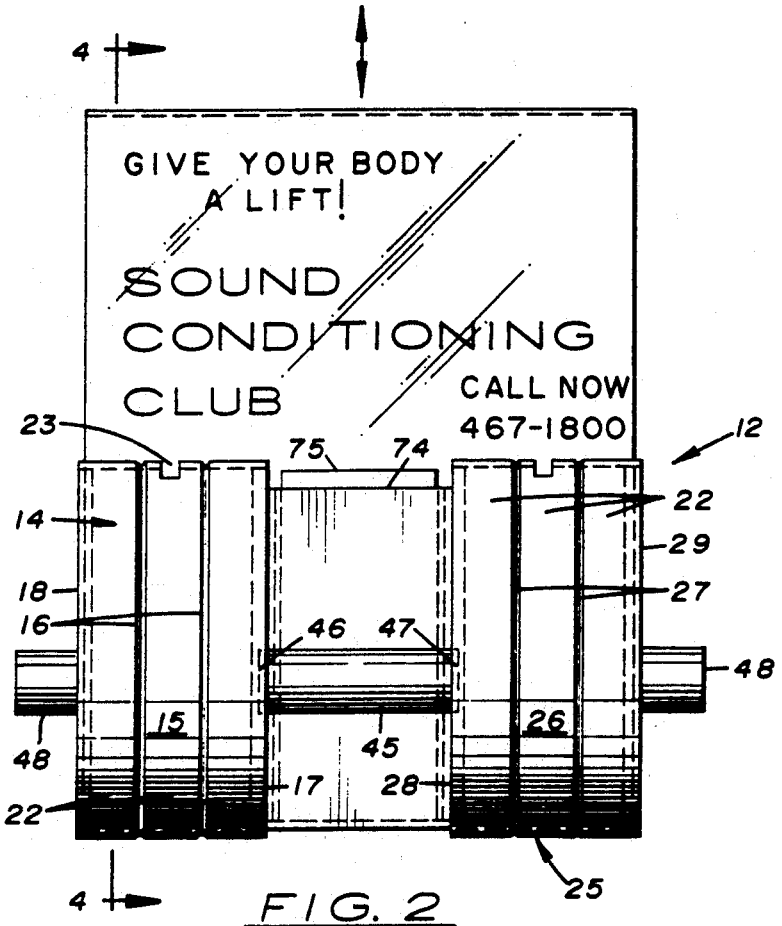
FIG. 2 is a front elevation view of the health club sales display shown in FIG. 1.
Figure 3:
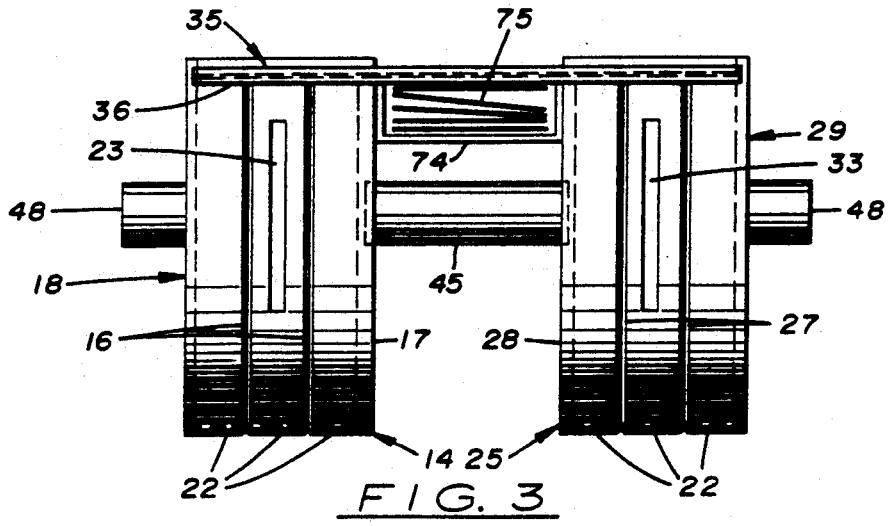
FIG. 3 is a side elevation view of the health club sales display shown in FIGS. 1–2.
Figure 4:
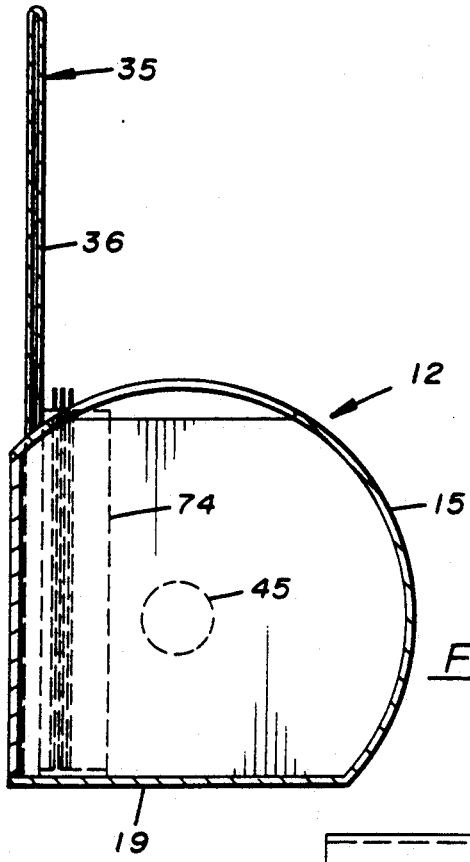
FIG. 4 is a sectional view of the health club sales display taken along line 4—4 in FIG. 2.

The bar element 45, which is circular in cross-section and approximately 1 inch in diameter and 9 inches in length, is disposed horizontally between the two weight stacks 14 and 25. In the preferred embodiment, the bar element 45 is made of clear or black acrylic material with first and second ends 46 and 47 thereof being either adhesively attached directly to the inner surfaces 17, 28 of the weight stacks 14, 25, respectively, or partially extended into each weight stack 14, 25, as shown in FIG. 2, 3, and 5, through bores (not shown) located centrally on the inner surfaces 17, 28. Caps 48 are attached to the outer surfaces 18, 29 of the weight stacks 14, 25, respectively, to simulate the ends of the bar element 45 extending through each weight stack.

As shown in FIGS. 1-5, a planar support member 35 is attached to the rear portion of the dumb-bell replica 12 so that its longitudinal axis 38 is substantially perpendicular to the dumb-bell's longitudinal axis 13. During use, the support member 35 is used hold a sign 40 having advertizing or other information printed thereon upright and above the dumb-bell replica 12 for viewing. The support member 35 is a rigid structure which may be either fixed or removably attached to the dumb-bell replica 12. The width of the support member is approximately the same as the length of the dumb-bell replica 12. The length of the support member 35 is sufficient so that the top edge of sign 40 is disposed 8 to 12 inches above the top edge of the dumb-bell replica 12. In the preferred embodiment, the support member 35 is made of clear acrylic material approximately ¼ inch thick. Other types of materials could be used to achieve the same purpose.

As mentioned above, the support member 35 may be either fixed or removably attached to the rear portion of the dumb-bell replica 12. In the preferred embodiment, the support member 35 is removably attached which enables the sales display 10 to be used as a lead box sales display. If the support member 35 is fixed to the rear portion of the dumb-bell replica 12, the sales display 10 can only be used as a point-of-purchase display.

Figure 6:
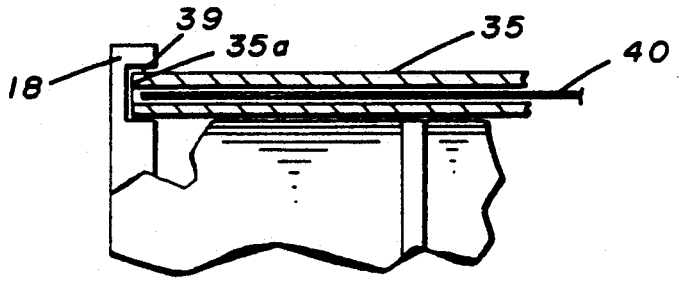
FIG. 6 is a sectional view of the health club sales display taken along line 7—7 in FIG. 4.

As shown in FIGS. 5-6, support member 35 is removably attached to the dumb-bell replica 12 by sliding the support member 35 into two vertical slots 39 manufactured on the inside surface of the outer vertical surface (vertical surface 18 shown) of each weight stack. The width of each vertical slot 39 is sufficient so that the vertical edges 35(a) of the support member 35 may slide freely therein. By sliding the support member 35 upward or downward within the slots 39, the operator gains access to the space located inside each weight stack 14 and 25 to collect the cards 70 or other items which may have been dropped therein.

Also shown in FIG. 5 an optional locking means is also provided which enables the operator of the sales display 10 to lock the support member 35 to the dumb-bell replica 12. The locking means comprises a clasp member 42 attached to the outer surface of the dumb-bar replica 12 which is capable of pivoting over the back surface of the support member 35 and sliding over an eyelet 43 attached thereto. A lock 44, activated by a key or combination code, is attached to the eyelet 43 to lock the support member 35 in place.

When designed to function as a lead box sales display, slots 23 and 33 are manufactured on one or both weight stacks 14, 25 to enable customers to drop cards or other items into the weight stacks.

Figure 7:
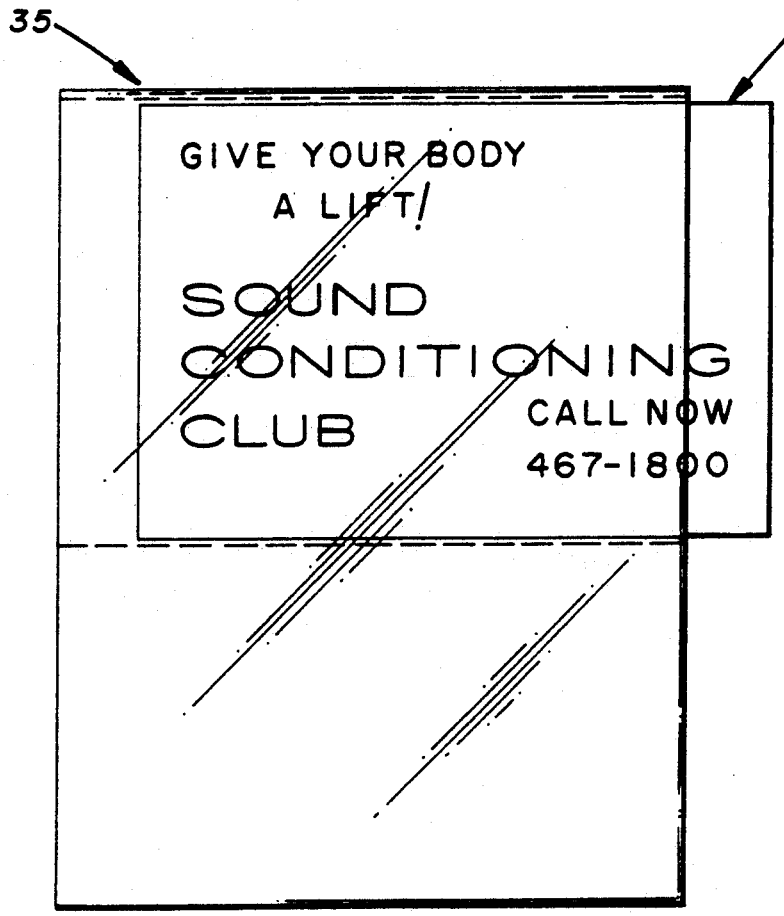
FIG. 7 is a front elevation view of the support member with a sign inserted therein.
Figure 8:
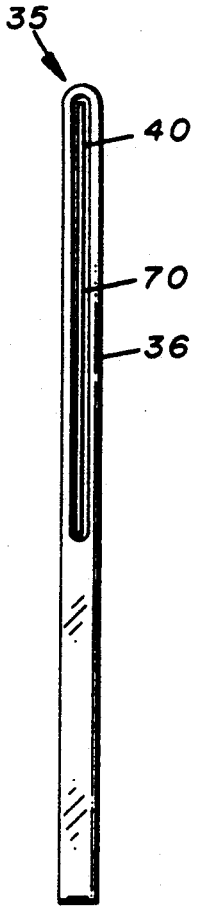
FIG. 8 is a side elevation view of the vertical support member shown in FIG. 6.
Figure 9:
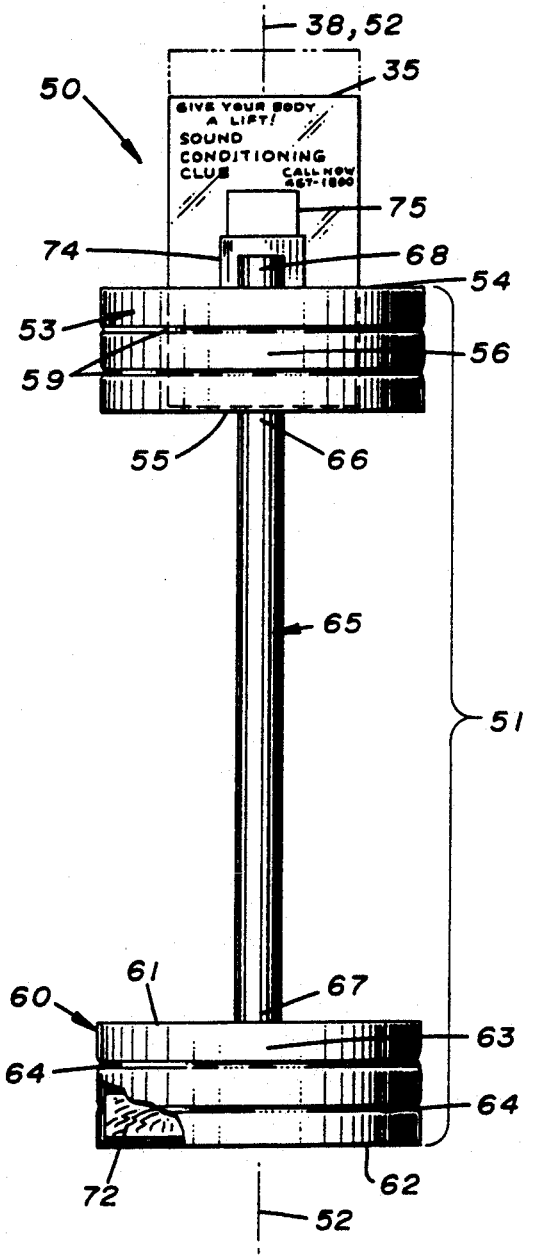
FIG. 9 is a front elevation view of another embodiment of the health club sales display.
Figure 10:
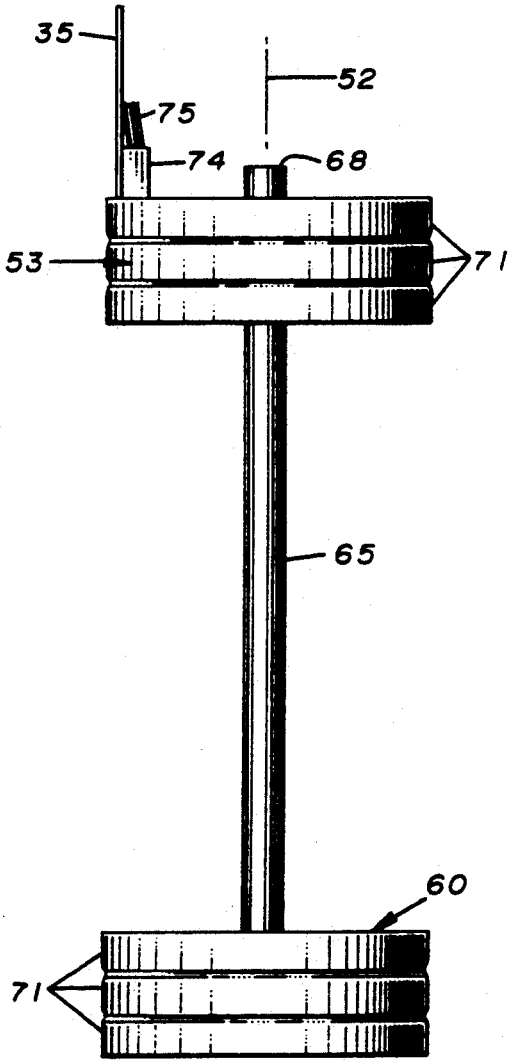
FIG. 10 is a side elevation view of the health club sales display shown in FIG. 9.

A holding means is provided to attached the sign 40 to the support member 35. Various types of holding means could be used with the invention, such as clamps or pins. When the support member 35 is made of clear acrylic material, the holding means comprises an elongated sleeve 37 manufactured vertically across and inside the support member 35, as shown in FIGS. 7 and 8. The longitudinal axis of the sleeve 37 is parallel to the front surface 36 of the support member 35. Sleeve 37 has sufficient length and width so that a sign 40 may slide horizontally along one edge inside the sleeve 70 and be seen through the front surface 36 of the support member 35.

As shown in FIGS. 1-4, an optional board holder 74 may be attached to the front surface 36 of the support member 35 between the left and right weight stacks 14, 25, respectively. The card holder 74 is designed to hold cards 75 or other similar items, in a conspicuous, convenient location on the sales display 10.

FIGS. 9-12 show a second embodiment 50 of the invention of the invention is shown designed to be a free standing sales display capable of standing upright on the floor. The second embodiment of the sales display 10 comprises a bar-bell replica 51 and a vertical support member 35. The bar-bell replica 51 includes a hollow upper weight stack 53 and a lower weight stack 60 separated by a bar element 65. The bar-bell replica 51 is designed so that the lower weight stack 60 may be positioned horizontally on the floor while the longitudinal axis 52 is aligned vertically. The bar element 65 is used to support the upper weight stack 53 over the lower weight stack 60.

The upper and lower weight stacks 53, 60 are each made of the same material used to manufacture the weight stacks 14, 25 used with the dumb-bell replica 12. Each weight stack 53, 60 is a hollow, cylindrical structure having circular, flat top surfaces 54, 61, respectively, and circular, flat bottom surfaces 55, 62, respectively, The outer surface 56, 63, of each weight stack 53, 60, respectively, is curved. Two parallel grooves 59 are formed along the outer surface 56 of the upper weight stack 53 and two parallel grooves 64 are formed along the outer surface 63 of the lower weight stack 60 to simulate three weight plates 71.

The bar element 65, made of approximate 1 inch diameter round acrylic material and approximately 32 inches in length, is disposed between the between the upper and lower weight stacks 53, 60. The top end 66 of the bar element 65 is attached to the bottom surface 55 of the upper weight stack 53. The bottom end 67 of the bar element 65 is attached to the top surface 61 of the lower weight stack 60. A cap 55 is attached to the top surface 54 of the upper weight stack 53 to simulate the end of the bar element 65 as it extends through the upper weight stack 53. An optional lead or wooden weight 68 may be placed inside the lower weight stack 60 to provide stability when the display 50 is placed in the upright position.

Figure 11:
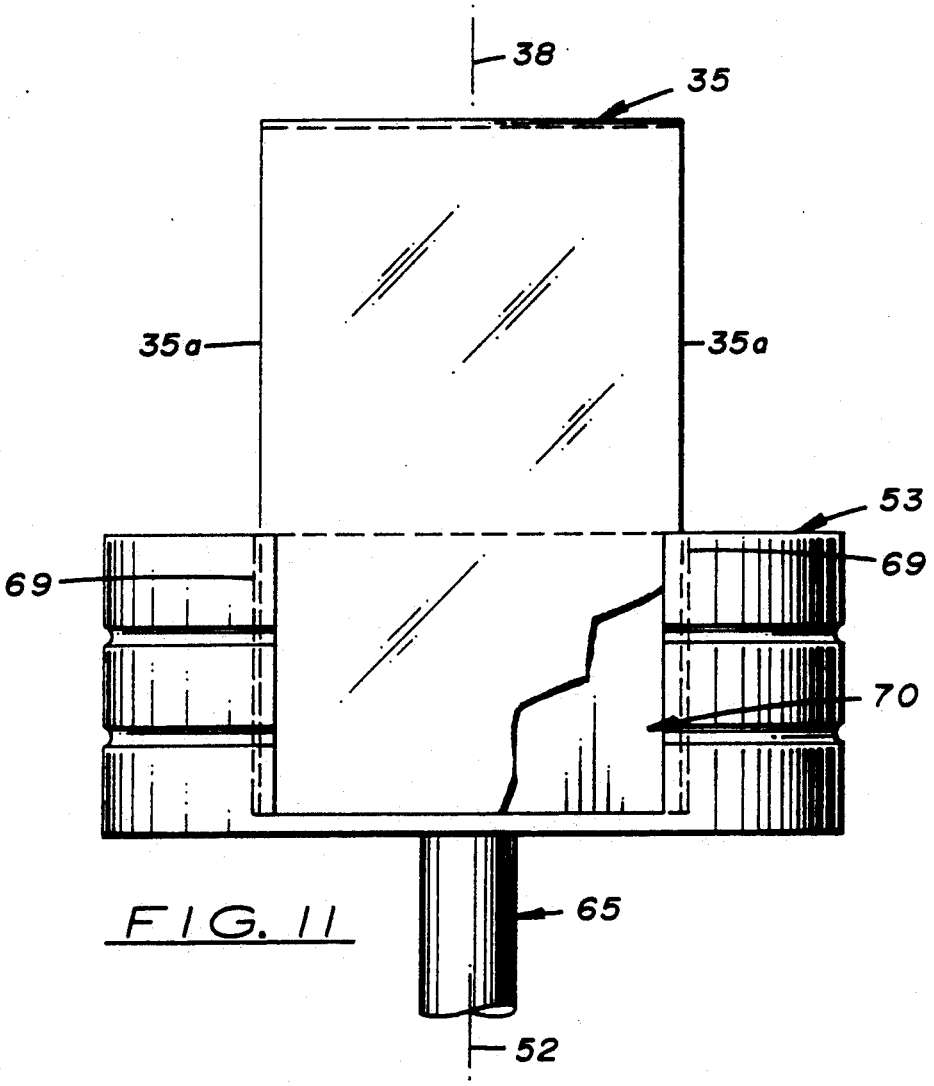
FIG. 11 is a rear elevation view of the health club sales display shown in FIGS. 9-10.

As shown in FIG. 11, the support member 35 is attached to the rear portion of the upper weight stack 53 with its longitudinal axis 38 parallel with the bar-bell replica's longitudinal axis 52. The rear portion of the upper weight stack 53 is cut away thereby creating a rear opening 70 into the upper weight stack 53. Two opposite vertical slots 69, similar to slots 39 located on weight stacks 14 and 25, are formed on each vertical side of the opening 70 which enables the support member 35 to slidingly engaged the upper weight stack 53.

Figure 12:
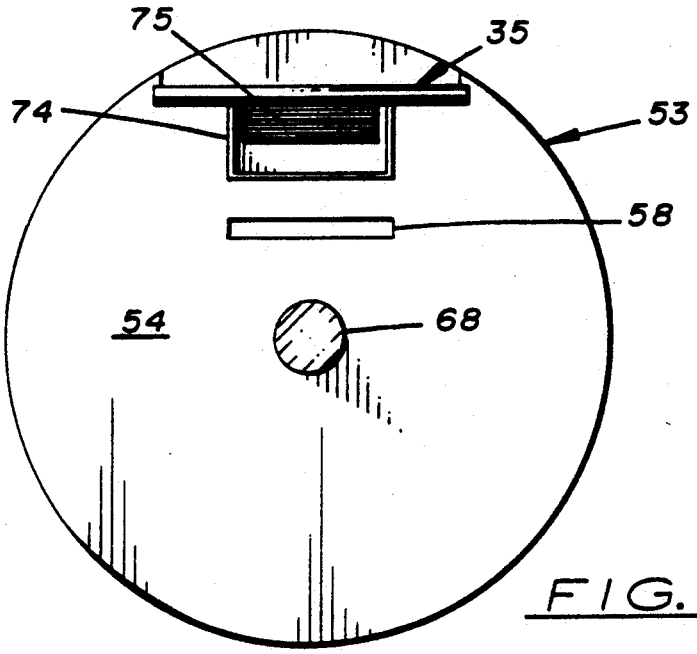
FIG. 12 is a plan view of the health club sales display shown in FIGS. 9-11.

As shown in FIG. 12, a slot 58 is manufactured in the top surface 54 of the upper weight stack 53 which enables a card or ticket to be placed inside the upper weight stack 53. Also, an optional card holder 74 may be attached to the front surface 36 of the support member 35 which is designed to hold cards 75 or tickets.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A health club sales display, comprising:

a. a free weight model made of lightweight, durable material, said free weight model having a longitudinal axis;

b. a planar support member, said support member having a longitudinal axis;

c. an attachment means capable of attaching said support member to said free weight model and disposing said support member above said free weight model, and;

d. a holding means capable of holding a sign having advertising or other information printed thereon to said support member.

2. A health club sales display as recited in claim 1 wherein said free weight model is a dumb-bell replica with said longitudinal axis disposed horizontally, said dumb-bell replica having a left and right weight stacks, each said weight stack being manufactured to simulate a plurality of weight plates, each said weight stack being spaced apart and interconnected by a bar element.

3. A health club sales display as recited in claim 2 wherein said support member is attached to said dumb-bell replica with said longitudinal axis of said support member is substantially perpendicular to said longitudinal axis of said dumb-bell.

4. A health club sales display as recited in claim 3, wherein said attachment means comprises two vertically slots formed on the inside surface of each said opposite outer vertical surfaces on each said weight stack, each said vertical slot being a sufficient width so that said support member may slidingly attached thereto.

5. A health club sales display as recited in claim 4, further including a card opening manufactured on one or both said weight stacks.

6. A health club sales display as recited in claim 5, further including a rear opening formed on each said weight stack thereby enabling the removal of a card inserted through said card opening and into said weight stack.

7. A health club sales display as recited in claim 6, wherein said holding means comprises said upper support surface being made of transparent material and a sleeve manufactured across said support member capable of receiving and holding said sign on one edge therein.

8. A health club sales display as recited in claim 7, further including a card holder attached to said support member.

9. A health club sales display as recited in claim 1 wherein said free weight model is a bar-bell replica, said bar-bell replica having an upper and lower weight stacks, each said weight stack simulating a plurality of weight plates, said upper stack having a top horizontal surface and said lower stack having a bottom horizontal surface, said upper and said lower weight stacks being spaced apart and interconnected by a bar element.

10. A health club sales display as recited in claim 9 wherein said support member is attached to the top surface of said upper stack, said support member being attached so that longitudinal axis is substantially parallel to said longitudinal axis of said bar-bell replica.

11. A health club sales display as recited in claim 10, wherein said attachment means comprises two vertical slots formed on said upper stack along said rear surface, each said vertical slot being a sufficient width so that said support member may be disposed between said slots and slidingly attached to said bar-bell replica.

12. A health club sales display as recited in claim 11, further including a card opening manufactured on said upper weight stack thereby enabling a card be inserted into said upper weight stack.

13. A health club sales display as recited in claim 12, further including a rear opening formed on said upper weight stack thereby enabling the removal of said card from said upper weight stack.

14. A health club sales display as recited in claim 13, further including a card holder attached to said support member.

15. A health club sales display, comprising:

a. a dumb-bell replica having a left and right weight stacks, each said weight stack simulating a plurality of vertically aligned weight plates, each said weight stack being hollow and having an outer vertical surface and being spaced apart and interconnected by a bar element, said dumb-bell replica having a longitudinal axis;

b. a support member attached to said dumb-bell replica between said weight stacks, said support member having a longitudinal axis;

c. an attachment means capable of sliding attaching said support member to said dumb-bell replica so that said longitudinal axis of said support member is substantially perpendicular to said longitudinal axis of said dumb-bell replica;

d. a holding means capable of holding a sign having advertising or other information printed thereon in a visible position on said support member when said support member is attached to said dumb-bell replica, and;

e. a card opening manufactured on one or both said weight stacks enabling a card to be inserted into said weight stack.

16. A health club sales display as recited in claim 15, wherein said holding means comprises said support member is made of transparent material and having a sleeve manufactured across said support member, said sleeve being capable of receiving and holding said sign on one edge therein.

17. A health club sales display as recited in claim 16, further including a card holder attached to said support member.

18. A health club sales display, comprising:

a. a bar-bell replica having an upper and lower weight stacks, each said weight stack simulating a plurality of vertically aligned weight plates, said upper weight stack being hollow and having a top vertical surface, said upper and lower weight stacks being spaced apart and interconnected by a bar element, said bar-bell replica having a longitudinal axis;

b. a support member attached to upper weight stack, said support member having a longitudinal axis;

c. an attachment means capable of sliding attaching said support member to said bar-bell replica so that said support member is extended above said upper weight stack and said longitudinal axis of said support member is disposed substantially parallel to said longitudinal axis of said bar-bell replica;

d. a holding means capable of holding a sign having advertising or other information printed thereon in a visible position on said support member, and;

e. a card opening manufactured on said upper weight stack enabling a card to be inserted into said upper weight stack.

19. A health club sales display as recited in claim 16, wherein said holding means comprises said support member being made of transparent material and having a sleeve manufactured across said support member, said sleeve being capable of receiving and holding said sign on one edge therein.

20. A health club sales display as recited in claim 19, further including a card holder attached to said support member.

* * * * *